US007846501B2

(12) United States Patent
Benson

(10) Patent No.: US 7,846,501 B2
(45) Date of Patent: Dec. 7, 2010

(54) METHOD OF MAKING OPAQUE PRINTED SUBSTRATE

(75) Inventor: William Mercer Benson, Harrison, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 749 days.

(21) Appl. No.: 11/454,663

(22) Filed: Jun. 16, 2006

(65) Prior Publication Data

US 2007/0059453 A1 Mar. 15, 2007

Related U.S. Application Data

(60) Provisional application No. 60/715,492, filed on Sep. 9, 2005.

(51) Int. Cl.
*B05D 5/00* (2006.01)
*B05D 5/06* (2006.01)

(52) U.S. Cl. ..... 427/265; 427/261; 427/258; 427/404; 427/419.1

(58) Field of Classification Search ..... 427/261, 427/265, 258, 404, 419.1; 206/269–773; 229/162.1–162.7; 428/13
See application file for complete search history.

(56) References Cited

U.S. PATENT DOCUMENTS 2,084,026 A * 6/1937 Gurwick ..... 428/209
2,235,791 A 3/1941 Wohlers
3,751,282 A 8/1973 Massa
4,290,533 A 9/1981 Rupp et al.
4,521,492 A * 6/1985 Allen ..... 428/464
5,037,682 A 8/1991 Gerstner et al.
5,106,126 A 4/1992 Longobardi
5,151,313 A 9/1992 Takeuchi et al.
5,333,549 A 8/1994 Feldman
5,407,711 A * 4/1995 Lovison et al. ..... 428/13
5,549,774 A 8/1996 Miekka et al.
5,629,068 A 5/1997 Miekka et al.
5,643,659 A 7/1997 Kobayashi
5,891,552 A 4/1999 Lu et al.
6,041,929 A 3/2000 Brunner (Continued)

FOREIGN PATENT DOCUMENTS

EP 0559754 B1 7/1997

(Continued)

OTHER PUBLICATIONS

International Search Report dated Apr. 19, 2007.

(Continued)

*Primary Examiner*—Michael Cleveland
*Assistant Examiner*—Alex Rolland
(74) *Attorney, Agent, or Firm*—Amanda T. Barry; Andrew J. Hagerty; Gary J. Foose

(57) ABSTRACT

Methods for making packaged consumer products are described. The methods generally include the steps of providing an opaque printed substrate, providing a plurality of individually wrapped disposable absorbent articles, and forming a package for containing the wrapped articles with the opaque printed substrate. The opaque printed substrate has a window section that contains ink that causes the overwrapping material of the articles to appear to have a different color when viewed from outside of the package.

4 Claims, 4 Drawing Sheets

U.S. PATENT DOCUMENTS

| | | | | |
|---|---|---|---|---|
| 6,042,888 | A * | 3/2000 | Sismanis et al. | 427/256 |
| 6,142,620 | A | 11/2000 | Sagi | |
| 6,480,217 | B1 | 11/2002 | Inoue | |
| 6,506,475 | B1 | 1/2003 | Hill | |
| 6,601,705 | B2 * | 8/2003 | Molina et al. | 206/494 |
| 6,680,103 | B1 | 1/2004 | Sloat | |
| 6,858,252 | B2 | 2/2005 | Sloat et al. | |
| 7,087,291 | B2 | 8/2006 | Hill | |
| 2002/0114933 | A1 | 8/2002 | Gould | |
| 2003/0130632 | A1 | 7/2003 | Costea et al. | |
| 2004/0005445 | A1 | 1/2004 | Ou Yang | |
| 2004/0101661 | A1 | 5/2004 | Sloat et al. | |
| 2004/0219344 | A1 | 11/2004 | Andes et al. | |
| 2005/0058782 | A1 | 3/2005 | Ou-Yang | |
| 2005/0092624 | A1 | 5/2005 | Harper | |
| 2005/0158524 | A1 | 7/2005 | Sloat et al. | |
| 2007/0002119 | A1 | 1/2007 | Abrott | |
| 2007/0059500 | A1 | 3/2007 | Benson | |

FOREIGN PATENT DOCUMENTS

| | | | |
|---|---|---|---|
| EP | 1186638 | A1 | 3/2002 |
| JP | 09086039 | A | 3/1997 |
| WO | WO 2006/087583 | A1 | 8/2006 |

OTHER PUBLICATIONS

U.S. Appl. No. 11/454,269, filed Jun. 16, 2006, William M. Benson.

Office Action for U.S. Appl. No. 11/732,778 dated Mar. 5, 2009; P&G Case CM3083Q; Kohlweyer et al.; filed Apr. 4, 2007.

Office Action for U.S. Appl. No. 11/732,778 dated Nov. 12, 2009; P&G Case CM3083Q; Kohlweyer et al.; filed Apr. 4, 2007.

Office Action for U.S. Appl. No. 11/454,269 dated Mar. 13, 2009; P&G Case 10134; Benson et al.; filed Jun. 16, 2006.

Office Action for U.S. Appl. No. 11/454,269 dated Oct. 1, 2009; P&G Case 10134; Benson et al.; filed Jun. 16, 2006.

http://www.bayplastics.co.uk/polyester_glazing.htm (Feb. 27, 2009).

Office Action for U.S. Appl. No. 11/454,269 dated Jan. 28, 2010; P&G Case 10134; Benson et al.; filed Jun. 16, 2006.

* cited by examiner

METHOD OF MAKING OPAQUE PRINTED SUBSTRATE

CROSS REFERENCE TO RELATED APPLICATION

This application claims the benefit of U.S. Provisional Application No. 60/715,492, filed Sep. 9, 2005.

FIELD OF THE INVENTION

The present invention relates generally to printed substrates used to form packages, adhesive tapes, wall coverings, surface coverings, surface linings, decorative tapes, pouches, envelopes, wraps, and labels. In particular, this invention is related to a method of making opaque printed substrates.

BACKGROUND OF THE INVENTION

There are a variety of types of packages in which consumer products are delivered to consumers. For many products, the package not only functions as a practical means for transporting and storing the product but also serves as a communication link between the seller and the consumer. Indicia such as labeling, stylized graphics, use of color and contrast, and touch and feel are all signals that can help consumers select the products they desire and forge a strong bond between the consumers and the brands of goods they purchase.

Many types of product packages do not allow the consumer to see the product contained therein. This can present a problem for retailers because consumers may open the package in the store to visually inspect the goods. In the worst cases, the consumer opens the package, determines the goods are not satisfactory, and leaves the opened package on the shelf. Some consumers even open a package to inspect the goods and then select an unopened package for purchase. In either case, if the package is for goods such as bandages, tissues, diapers, catamenial devices, food products, cosmetics, medicines, cleaning supplies, or detergents, the retailer is left with an opened package that may no longer be suitable for sale.

One common method for helping consumers select the right product is to design the package such that the consumer can see the product while the product is still in the package without opening the package. Packages can be formed from clear or translucent materials through which the product can be seen. A drawback to packages formed of clear or translucent materials is that the attractiveness of the product package may be less than desired because the product contained in the package can interfere with the indicia on the exterior of the package.

To overcome this deficiency, some consumer products are packaged in containers having windows through which the consumer can see the product, with the remainder of the package devoted to other means for the connecting the seller with the consumer, such as indicia. For instance, cardboard containers for spaghetti often have a window cutout that is covered with a clear film through which the consumer can see the spaghetti and judge its quality and suitability. Sellers of some types of cookies package the cookies in clear packages and indicia do not cover the entire package, thereby allowing the consumer to the see the cookies in the package without opening the package.

Many products, such as diapers, sanitary napkins, and laundry detergent are packaged in film bags. To support the highest quality artwork and indicia on the outside of the package, metal impregnated and metalized films are often used. These types of films can be essentially opaque and can be bright white or any other color desired. Thus, color of the product contained within the package does not interfere with the message conveyed on the exterior of the container. The solid color serves as the canvas upon which any indicia such as labeling, color, images, graphics or the like can be printed. One drawback to using opaque films in packaging is that the consumer is unable to see the product contained therein and the previously mentioned problems associated with consumers inspecting the contents can arise.

Printed clear or low opacity films are an alternative to opaque films and can enable consumers to see the products contained in a package. Areas of the package are left unprinted to form windows through which the consumer can see the product. In a typical application, a layer of high opacity white ink is printed over portions of the clear or translucent bag to provide for opacity. Then, additional printing on the white can be used for indicia such as labeling, artwork or the like. The white printed film forms the canvas upon which any color desired can be printed. For example, individual wrappers for sanitary napkins can be color coded to correspond with particular levels of absorbency and a window in the package can allow the consumer to see the color of the wrapper of the individual sanitary napkins without opening the package. Printed clear or low opacity films can also be designed to have opacity that varies from region to region, thereby allowing package designers to use variable opacity of the package as a design element.

The level of opacity that can be achieved by printing high opacity white over a clear or translucent film can be as high as 60 to 80%. This level of opacity can be insufficient to prevent color shifting of the printing on the exterior of the package. Color shifting of external indicia can be particularly problematic for goods that have different colors than the colors of the external indicia. Color shifting can also be a problem when the goods are individually wrapped in a material having a color that differs from the colors presented on the exterior of the package. Furthermore, color shifting can occur as the package is emptied, leaving the full portion of the package having one color and the emptied portion of the package having another color. Color shifting of external indicia, such as labeling, artwork, graphics, and the like can be a problem for sellers who use color to communicate with the consumer. Sellers may desire consistent coloring of their brand in all of the communications they have with consumers through print media, video, product packaging, and product placement to build and maintain consistent brand equity. Inconsistent colors amongst various media can weaken the power of the brand. Clear or translucent rigid printed substrates for products such as detergent, motor oil, rice, juice, and the like are subject to these same limitations.

For some products, labeling, artwork, indicia, and the like appear on both the exterior and interior of the package. To prevent the indicia on the interior of the package from interfering with the indicia on the exterior of the package and vice versa, it can be necessary to use a laminated film structure having a highly opaque core to stop the interference. Laminated films can be difficult and expensive to manufacture because the layers must be joined and more layers of film are required to form the product package.

Some consumer products packaged in film containers may also react with ink printing on the interior of the package. For instance, some detergents can react with inks used to print on the interior of film packages. A laminated package can be used to overcome this problem by covering the printed film on the product side of the package with a clear or translucent material to protect the indicia visible on the interior of the package without obscuring the indicia.

In light of the above, there is a continuing unaddressed need for opaque printed substrates that can be made with clear or low opacity films.

Additionally, there is a continuing unaddressed need for substrates having opacity that varies from region to region on the film.

Furthermore, there is a continuing unaddressed need for high opacity printed substrates in which windows can be left to allow consumers to see the contents of packages formed with opaque printed substrates.

Additionally, there is a continuing unaddressed need for high opacity printed substrates made of clear or low opacity substrates on which printing can be made on both sides of the opaque printed substrate without using a laminated substrate.

SUMMARY OF THE INVENTION

A method of making an opaque printed substrate is disclosed. First a first application is applied to a substrate, wherein the first application is selected from the group consisting of metallic ink and ink, forming a first unit having a first and second side. A second application is applied on the first unit, wherein the second application is selected from the group consisting of metallic ink and ink, wherein the second ink differs from the first application.

BRIEF DESCRIPTION OF THE DRAWINGS

While the specification concludes with claims particularly pointing out and distinctly claiming the subject matter that is regarded as forming the present invention, it is believed that the invention will be better understood from the following description taken in conjunction with the accompanying drawings, in which:

Figure 1:
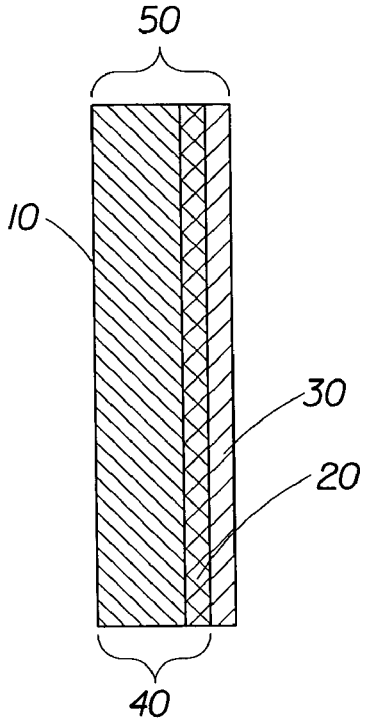
FIG. 1 is a cross sectional view of an opaque printed substrate in which a metallic ink is placed on the substrate and an ink is placed on the metallic ink.

The accompanying drawings are not to scale with respect to any dimension. In general, the thickness of any application of ink, metallic ink, or additional ink is thin relative to the thickness of the substrate. The accompanying drawings illustrate applications of ink, metallic ink, and additional ink to be much thicker relative to the thickness of the substrate for clarity. The accompanying drawings illustrate the thickness of the substrate to much thicker than the thickness of the substrate would be in most applications. The accompanying drawings illustrate applications of ink, metallic ink, and additional ink to be much thicker than the thickness of these applications would be in most applications.

DETAILED DESCRIPTION OF THE INVENTION

The present invention relates to opaque printed substrates. The benefits of the invention can be enjoyed in virtually all applications in which printed substrates can be used. Printed substrates can be used in product packaging, containers, wallpaper, fastening tape, decorative tape, food wraps, paper products, wipes, and the like. The invention will be disclosed herein with respect to the Figures as a preferred embodiment of product packaging.

As used herein, the term "substrate" refers to any material that can be printed on. Substrates include, but are not limited to, materials such as plastics, plastic films, fabrics, papers, polymer films, non-woven webs or fabrics, woven webs or fabrics. Woven and non-woven webs can be formed from monocomponent fibers, bicomponent fibers, multiconstituent fibers, capillary channel fibers, and the like. Substrates also include blown or cast film materials in a blend of low density polyethylene and linear low density polyethylene, metallocenes, ethylene vinyl acetate, SURLYN®, polyethylene terephthalate, biaxially oriented polypropylene, and nylon. A substrate can be two or more substrates laminated together. A substrate can be metal. A substrate can be pigmented. A substrate can be clear. A substrate can be opaque.

As used herein, the term "pigmented substrate" refers to a substrate that is colored.

As used herein, the term "first unit" refers to a substrate upon which is placed a first application. The first unit can be a substrate on which a metallic ink is placed. The first unit can be a substrate upon which an ink is placed. Metallic ink or ink can be placed on the substrate by any means known in the art including but not limited to by hand, printing, brushing, and spraying. The first unit can be a substrate, one side of which is entirely covered by the first application. The first unit can be a portion of a substrate, one side of which covered by a first application.

As used herein, the term "first application" refers to the first material placed on a substrate. The first application can be a metallic ink. The first application can be an ink. The first application can be placed on a substrate by any means known in the art including but not limited to by hand, printing, brushing, and spraying. The first application can be applied to the entire surface of one side of the substrate. The first application can be applied to a portion of one side of the substrate.

As used herein, the term "second application" refers to the material placed on one or both sides of the first unit. The second application can be a metallic ink. The second application can be an ink. The second application can be applied to the entire surface of one side of the first unit. The second application can be applied to the entire surface of both sides of the first unit. The second application can be applied to a portion of one or both sides of the first unit. The second application can be applied to the entire surface of one side of the first unit and a portion of the other side of the first unit. The second application can be placed on the first unit by any means known in the art including but not limited to by hand, printing, brushing, and spraying. The second application can be applied after an additional ink is applied if the additional ink is applied first to one side of the first unit and the second application is applied to the other side of the first unit.

As used herein, the term "ink" refers to a colored, usually liquid, material for writing and printing. Generally, ink has four main ingredients: (1) colorant, which is composed of a pigment or mixture of pigments which define the color of the colorant, (2) resin, which is a binder that can be soluble or in a solvent and the binder holds the colorant on a substrate, (3) solvent or water to dissolve the resin, and (4) additives to adjust properties of the ink. Pigments can be organic and inorganic substances.

As used herein, the term "metallic ink" refers to an ink to which metal flakes are added as a pigment additive to the ink. Metallic inks when printed can appear to be reflective or shiny.

As used herein, the term "opaque" refers to a substrate or printed substrate that has an opacity greater than or equal to 50%.

As used herein, the term "opacity" refers to the property of a substrate or printed substrate which measures the capacity of the substrate to hide or obscure from view an object placed behind the substrate relative to point from which observation is made. Opacity can be reported as the ratio, in percent, of the diffuse reflectance of a substrate backed by a black body having a reflectance of 0.5% to the diffuse reflectance of the same substrate backed with a white body having an absolute reflectance of 89%. Opacity can be measured as described in ASTM D 589-97, Standard Test Method for Opacity of Paper (15°/Diffuse Illuminant A, 89% Reflectance Backing and Paper Backing).

A substrate high in opacity will not permit much, if any, light to pass through the substrate. A substrate having low opacity will permit much, if not nearly all, light to pass through the substrate. Opacity can range from 0 to 100%.

As used herein, the term "low opacity" refers to a substrate or printed substrate having opacity less than 50%.

As used herein, the term "high opacity" refers to a substrate or printed substrate having opacity greater than or equal to 50%As used herein, the term "low gauge" refers to a substrate having a thickness less than 250 microns.

As used herein, the term "clear substrate" refers to a substrate or a window of a substrate through which objects can be viewed and the objects on one side of the substrate when viewed from the other side of the substrate appear substantially the same with respect to color and shape as if there were no substrate between the viewer and the object.

As used herein, the term "substantially clear" refers to a substrate or a window of a substrate through which objects can be viewed and the objects on one side of the substrate when viewed from the other side of the substrate appear nearly the same with respect to color and shape as if there were no substrate between the viewer and the object, although the color and shape can be slightly distorted.

As used herein, the term "indicia" refers to markings or indications that can be used to convey a message. The message conveyed can be an indication of source, the characteristics of a product in a package, the quantity of a product in a package, the quality of a product in a package, or any other message. Indicia can be a single color such as a light pink to indicate the source of a particular building insulation. Indicia can be a symbol such as a graphic resembling a target used for training archers to indicate a particular retail store. Indicia can be text in any language or combination of languages representative of verbal communication. Indicia can be patterns of colors, lines, or combinations thereof such as that often appearing on Scottish kilts and possibly used to indicate the source of an adhesive tape. Indicia can be illustrations of tangible objects such as an apple indicating the source of a particular brand of computer. Indicia can be artwork depicting tangible objects or imaginary compositions or any kind of marking. A single dot of a single color can be indicia. Indicia can be the type, texture, smell, or sound when rustled of the material used to form a package. Indicia can be a combination of any and all of the indicia described previously.

As used herein, the term "disposable absorbent articles" refers to catamenial devices, sanitary napkins, panti-liners, tampons, diapers, incontinence devices, wipes, facial tissue, paper towels, toilet paper, and the like.

As used herein, the term "cleaning product" refers to detergents, laundry detergents in a liquid or powdered form, dishwasher detergents in a liquid or powdered form, or any other liquid, suspension, emulsion, powder, or granules used for cleaning.

As used herein, the terms "first side" and "second side" refer to the major planar like surfaces of the substrate. For example a classic sheet of notebook paper can be considered to have a first side and a second side available for writing upon. The surfaces of the first side and second side can be flat or curved or a combination of flat and curved surfaces.

The present invention can be best understood by examining cross sections of opaque printed substrates. A cross section of an opaque printed substrate 50 is shown in FIG. 1. The opaque printed substrate 50 can be comprised of a substrate 10, a metallic ink 20, and an ink 30. Opaque printed substrates used in product packaging can be described as having an exterior surface and an interior surface. The exterior surface is the surface of the package facing the consumer. The interior surface is the surface of the package facing the product contained within the package.

FIG. 1 is a cross section of an opaque printed substrate 50. As shown in FIG. 1, a metallic ink 20 can be placed on substrate 10. Together, substrate 10 and metallic ink 20 can form first unit 40. As shown in FIG. 1, the first application can be metallic ink 20. Ink 30 can be placed on first unit 40. As shown in FIG. 1, ink 30 can be the second application.

Figure 2:
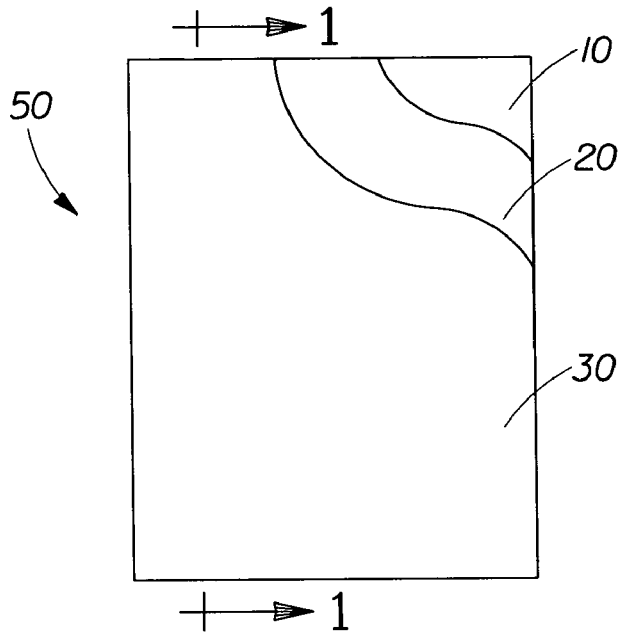
FIG. 2 is a cutaway plan view of the opaque printed film illustrated in cross section in FIG. 1 where Section 1-1 is shown in FIG. 1.

FIG. 2 is a cutaway plan view of the opaque printed substrate 50 illustrated in cross section in FIG. 1. As shown in FIG. 2, a metallic ink 20 can be placed on substrate 10. Together, substrate 10 and metallic ink 20 can form first unit 40. Ink 30 can be placed on first unit 40. Ink 30 can be indicia 130 having any color. Ink 30 can be a single color such as white upon which other colors can be placed. As shown in FIG. 2, the backdrop against which ink 30 can be viewed can be metallic ink 20 and substrate 10. Taken together, the substrate 10, metallic ink 20, and ink 30 can be the opaque printed substrate 50.

Ink 30 can be indicia 130 having any color. Ink 30 can be a single color such as white upon which other colors can be placed. As shown in FIG. 1, the backdrop against which ink 30 can be viewed can be metallic ink 20 and substrate 10. Taken together, the substrate 10, metallic ink 20, and ink 30 can be the opaque printed substrate 50. When the opaque printed substrate 50 is oriented such that ink 30 is on exterior surface of the package facing the consumer, ink 30 or the combination of one or more of the substrate 10, metallic ink 20, and ink 30 can serve as indicia 130 designed to aid the consumer in selecting the product contained within the package. When the opaque printed substrate 50 is oriented such that the ink 30 is on the interior surface of the package facing the product, ink 30 or the combination of one or more of substrate 10, metallic ink 20, and ink 30 can serve as indicia 130 that can be observed on the interior of the package after the package has been opened.

Substrate 10 can be Exopack 1020 film available from Exopack LLC, Spartanburg, S.C. Metallic ink 20 can be silver ink TLOFSM038662 available from Sun Chemical Corp., Parsippany, N.J. Ink 30 can be white ink TLKFS1035477, also available from Sun chemical Corp.

Substrate 10 can be any thickness. Preferably the thickness of substrate 10 is less than 6000 microns. More preferably the thickness of substrate 10 is less than 1000 microns. Even more preferably the thickness of substrate 10 is less than 500 microns. Even more preferably the thickness of substrate 10 is less than 250 microns. Most preferably, the thickness of substrate 10 is less than 100 microns.

For polymeric film substrates, preferably the thickness of the substrate 10 is less than 250 microns. More preferably, for polymeric film substrates the thickness of the substrate 10 is less than 150 microns. Most preferably, for polymeric film substrates the thickness of the substrate 10 is less than 100 microns.

Some designers of the visual elements of product packages believe that in some designs, indicia 130 are best placed on a material having high opacity. Preferably, the opaque printed substrate 50 has opacity greater than or equal to 50%. More preferably, the opaque printed substrate 50 has opacity greater than 60%. More preferably, the opaque printed substrate 50 has opacity greater than 70%. Even more preferably, the opaque printed substrate 50 has opacity greater than 80%. Most preferably, the opaque printed substrate 50 has opacity greater than 90%.

The opaque printed substrate 50 can have opacity that is uniform about the entire plane of the opaque printed substrate 50. Alternatively, the opacity of the opaque printed substrate 50 can vary from one region to another within the plane of the opaque printed substrate 50. For example, the opaque printed substrate 50 in one region of the substrate may have opacity that differs from the opacity of the opaque printed substrate 50 in an adjacent region.

The opacity of an opaque printed substrate 50 can be low enough in some regions such that there is a low opacity region that is a window 60. A window 60 can be a region of the opaque printed substrate 50 having low opacity adjacent to a region having higher opacity. A window 60 can be clear or be substantially clear. A window 60 can be a region of substrate 10 to which no metallic ink 20 or ink 30 is applied, the window being essentially in plane with the opaque printed substrate 50. A window 60 can be a region of substrate 10 upon which only ink 30 is applied. A window 60 can be a region of substrate 10 upon which only metallic ink 20 is applied. The opacity of a window 60 can be less than 50%. Preferably, the opacity of a window 60 can be less than 40%. More preferably, the opacity of a window 60 can be less than 30%. Even more preferably, the opacity of a window 60 can be less than 20%. Most preferably, the opacity of a window 60 can be less than 10%.

Within the context of this description of a window 60, a window 60 is "clear" if an object on one side of the opaque printed substrate 50 can be viewed through a window 60 in an opaque printed substrate 50 and the object appear the same as if there were no material between the viewer and the object. A window 60 can be "substantially clear" if objects on one side of the opaque printed substrate 50 can be viewed through a window 60 and the color of the objects is shifted, the geometry of the object distorted, or both the color of the object is shifted and the geometry of the object is distorted. A color is considered shifted when the object appears to have one color when viewed through a window 60 and appears to have a different color when the object is viewed directly, with no window 60 between the viewer and the object. The window 60 can be a pigmented substrate selected to desirably shift the color of the object when viewed through the window 60. The window 60 can be clear substrate on which ink 30 or metallic ink 20 is placed, thereby creating a window 60 that generates a desired color shift.

The window 60 can allow consumers to see the contents of a particular package to aid the consumer in selecting the proper package or to allow the consumer to judge the quality of the contents of a package. Where the contents of a package are sanitary napkins, the window 60 can allow consumers to see the thickness of the sanitary napkins and the color of the over-wrapping of the sanitary napkin that can be indicative of absorptive capacity.

The window 60 can have a classical geometric shape such as a multisided polygon including but not limited to a triangle, square, or a rectangle. The window 60 can be circular or oval shaped. The window 60 can have an irregular shape having straight edges, curved edges, or a combination of straight and curved edges. The window 60 can have an irregular shape defined by the boundaries of the opaque printed substrate 50 and indicia 130 or combinations of the opaque printed substrate 50 and indicia 130. The window 60 can account for less than 10% of the total surface area of the opaque printed substrate 50. The window 60 can account for less than 25% of the total surface area of the opaque printed substrate 50. The window can account for more than 50% of the total surface area of the opaque printed substrate 50. The window can account for more than 75% of the total surface area of the opaque printed substrate 50. The window can account for more than 90% of the total surface area of the opaque printed substrate 50.

Figure 3:
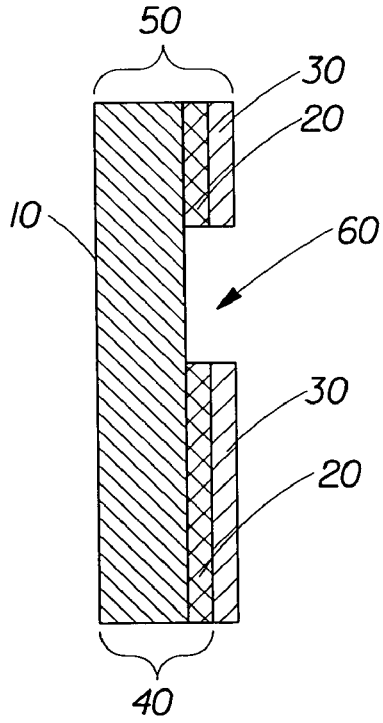
FIG. 3 is a cross sectional view of an opaque printed substrate in which a metallic ink is placed on a substrate and an ink is placed on the metallic ink and the opaque printed substrate has a window.

FIG. 3 is a cross section of opaque printed substrate 50 shown in FIG. 1 having a window 60. The opaque printed substrate 50 is a substrate 10, metallic ink 20 placed on the substrate 10, and ink 30 placed on metallic ink 20. The window 60, as shown in FIG. 3, can be a region of the substrate 10 to which no metallic ink 20 or ink 30 is applied. The opaque printed substrate 50 shown in FIG. 3 can be formed into a package and the printed substrate can be oriented such that the substrate 10 is on the interior surface of a package. In the alternative, the substrate 10 can be the exterior surface of a package.

An adhesive can be applied to opaque printed substrate 50 shown in FIGS. 1 and 2 to form an adhesive tape and the adhesive tape can have one or more windows 60. An adhesive can be applied to opaque printed substrate 50 to form a surface cover such as wallpaper, contact paper, shelf covering, labeling tape and the surface covering can have one or more windows 60.

Figure 4:
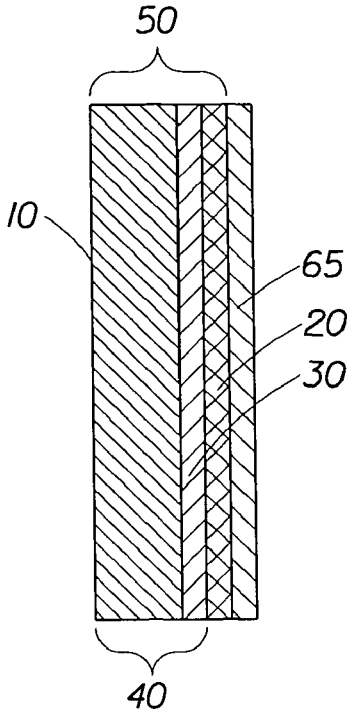
FIG. 4 is a cross sectional view of an opaque printed substrate in which an ink is placed on a substrate, a metallic ink is placed on the ink, and an additional ink is placed on the metallic ink.

As shown in FIG. 4, ink 30 can be placed on a substrate 10. As shown in FIG. 4, the first application can be ink 30. Together, substrate 10 and ink 30 can form first unit 40. Metallic ink 20 can be placed on the first unit 40 on the side of the substrate on which ink 30 is applied. As shown in FIG. 4, second application can be metallic ink 20. The opaque printed substrate 50 can be substrate 10, ink 30 placed on substrate 10 forming first unit 40 and metallic ink 20 placed on ink 30. Ink 30 can be indicia. Ink 30 can be a single color such as white. Ink 30 can be multiple layers of ink such that first indicia is placed on substrate 10, a white ink is placed on ink 30 to provide a white base against which ink 30 can be viewed. Indicia such as text can be reverse printed on substrate 10 such that when the text is viewed through the substrate 10 side of the first unit 40 the text appears properly. As shown in FIG. 4, ink 30 can be viewed through substrate 10 and metallic ink 20 forms the opaque background against which ink 30 can be viewed. As illustrated in FIG. 4, an optional additional ink 65 can be placed on the metallic ink such that printing can be viewed from both sides of the substrate 10. As shown in FIG. 4, substrate 10 can be oriented such that the substrate 10 is on the interior surface of a package or on the exterior surface of a package and still provide for printing that can be viewed from both the exterior and interior of a package. Preferably, substrate 10 can be oriented such that substrate 10 is on the interior surface of a package to protect ink 30, as well as additional ink 65 if included, from adverse interactions with any product contained in a package.

Figure 5:
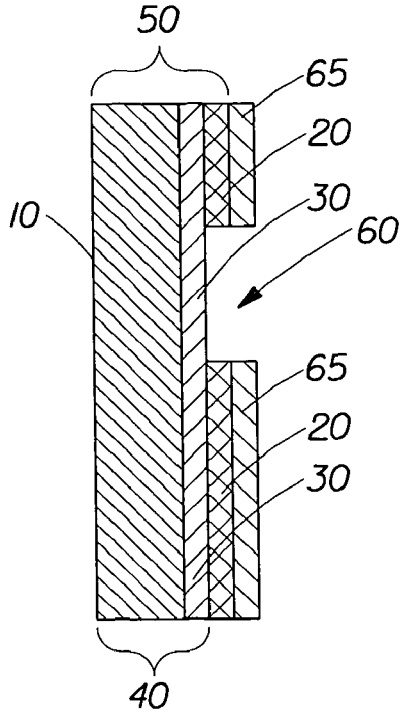
FIG. 5 is a cross sectional view of an opaque printed substrate in which an ink is placed on a substrate, a metallic ink is placed on the ink, and an additional ink is placed on the metallic ink, and the opaque printed substrate has a window.

A cross section of opaque printed substrate 50 illustrated in FIG. 4 having a window is shown in FIG. 5. As shown in FIG. 5, ink 30 can be placed on substrate 10, metallic ink 20 can be placed on ink 30, and an additional ink can be placed on metallic ink 20 and the opaque printed substrate 50 has a window. The opaque printed substrate 50 is substrate 10, ink 30 placed on substrate 10 forming first unit 40 and metallic ink 20 placed on ink 30. As illustrated in FIG. 5, an optional additional ink 65 can be placed on metallic ink 20 such that printing can be viewed from both sides of the substrate 10. The window 60, as shown in FIG. 5, can be a region of the substrate 10 to which no metallic ink 20, ink 30, or additional ink 65 is applied. The opaque printed substrate 50 shown in FIG. 5 can be formed into a package and the opaque printed substrate 50 can be oriented such that the substrate 10 is on the interior surface of a package. In the alternative, the substrate 10 can be the exterior surface of a package.

An adhesive can be applied to opaque printed substrate 50 shown in FIGS. 3 and 4 to form an adhesive tape and the adhesive tape can have one or more windows 60. An adhesive tape made of an opaque printed substrate could have indicia 130 visible from one or both sides of the adhesive tape.

Figure 6:
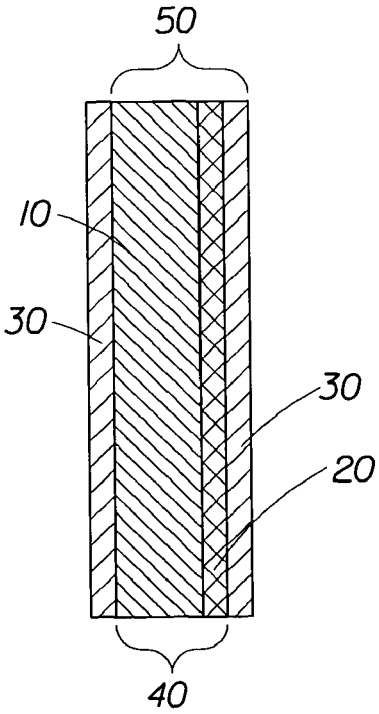
FIG. 6 is a cross sectional view of an opaque printed substrate in which a metallic ink is placed on one side of a substrate, an ink is placed on the other side of the substrate, and an additional ink is placed on the metallic ink.

As shown in FIG. 6, metallic ink 20 can be placed on a substrate 10. Together, substrate 10 and metallic ink 20 can form a first unit 40. As shown in FIG. 6, metallic ink 20 can be the first application. The second application can be ink 30. Ink 30 can be placed on first unit 40 on the side of the substrate 10 opposite to the side of substrate 10 on which metallic ink 20 can be placed. As shown in FIG. 6, ink 30 can be placed on both sides of first unit 40 thereby permitting printing that can be viewed from both sides of substrate 10.

Alternatively, ink 30 placed on substrate 10 can be the first application and metallic ink 20 can be the second application. The opaque printed substrate 50 can be substrate 10, ink 30 placed on substrate 10 forming first unit 40, and metallic ink 20 placed on substrate 10. Ink 30 can be indicia. Ink 30 can be a single color such as white. Ink 30 can be multiple layers of ink such as a white ink placed on substrate 10 to form a backdrop upon which other colors can be placed. If ink 30 is considered to be the first application, then ink 30 placed on the side of substrate 10 that metallic ink 20 is placed on could be considered an additional ink. As shown in FIG. 6, metallic ink 20 can form the opaque background against which ink 30 can be viewed.

Figure 7:
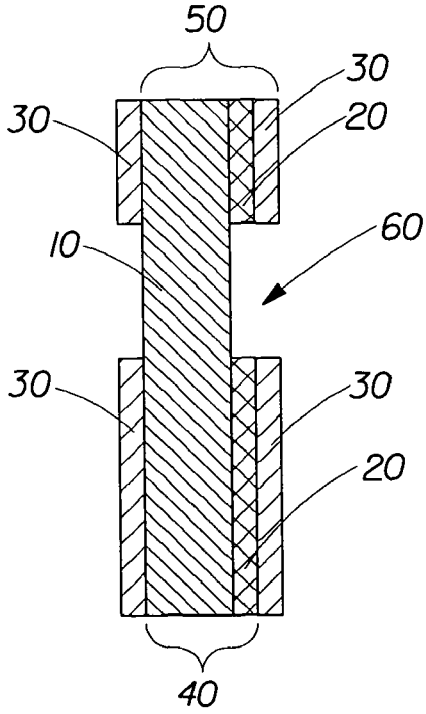
FIG. 7 is a cross sectional view of an opaque printed substrate in which a metallic ink is placed on one side of a substrate, ink is placed on the other side of the substrate, and an addition ink is placed on the metallic ink and the opaque printed substrate has a window.

A cross section of opaque printed substrate 50 illustrated in FIG. 6 having a window is shown in FIG. 7. As shown in FIG. 7, metallic ink 20 can be placed on substrate 10 to form the first unit 40. Ink 30 can be placed on both sides of the first unit 40. The opaque printed substrate 50 can be substrate 10, metallic ink 20 placed on substrate 10 forming first unit 40, and ink 30 placed on one or both sides of first unit 40. The window 60, as shown in FIG. 7, can be a region of the substrate to which no ink 30, metallic ink 20, or additional ink is applied. The opaque printed substrate 50 shown in FIG. 7 can be formed into a package and the metallic ink 20 can be oriented more closely towards the interior of the package or the exterior of the package.

An adhesive can be applied to opaque printed substrate 50 shown in FIGS. 5 and 6 to form an adhesive tape and the adhesive tape can have one or more windows 60. An adhesive tape made of an opaque printed substrate could have indicia visible from both sides of the adhesive tape.

Figure 8:
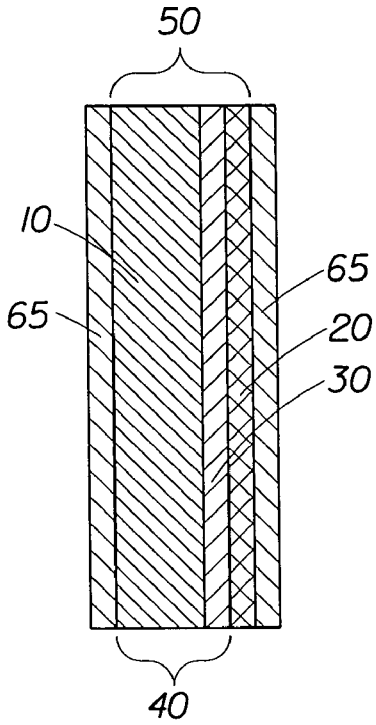
FIG. 8 is a cross sectional view of an opaque printed substrate in which an ink is placed on one side of the substrate, a metallic ink is placed over the ink, an ink is printed on the metallic ink, and an additional ink is placed on the other side of the substrate.

As shown in FIG. 8, ink 30 can be placed on substrate 10. Together, substrate 10 and ink 30 can form first unit 40. As shown in FIG. 8, ink 30 can be the first application. Metallic ink 20 can be placed on first unit 40 on the side of substrate 10 on which ink 30 is applied. As shown in FIG. 8, metallic ink 20 can be the second application. The opaque printed substrate 50 can be substrate 10, ink 30 placed on substrate 10 forming first unit 40 and metallic ink 20 placed on ink 30. Ink 30 can be a single color such as white. An optional additional ink 65 can be placed on the side of the first unit 40 not having metallic ink 20. Ink 30 can be white backdrop against which additional ink 65 can be viewed from the side of the first unit not having metallic ink 20. An optional additional ink 65 can also be placed on metallic ink 20 such that printing can be viewed from both sides of substrate 10.

Figure 9:
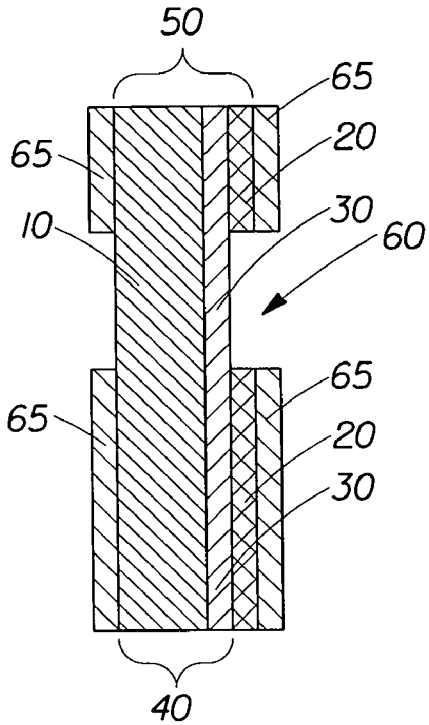
FIG. 9 is a cross sectional view of an opaque printed substrate in which an ink is placed on one side of a substrate, a metallic ink is placed over the ink, an ink is printed on the metallic ink, and an additional ink is placed on the other side of the substrate and the opaque printed substrate has a window.

A cross section of opaque printed substrate 50 illustrated in FIG. 8 having a window is shown in FIG. 9. As shown in FIG. 9, ink 30 can be placed on substrate 10, metallic ink 20 can be placed on ink 30 to form opaque printed substrate 50, an additional ink 65 can be placed on the side of the first unit 40 not having metallic ink 20, an additional ink 65 can also be placed on metallic ink 20, and the opaque printed substrate 50 can have a window 60. The opaque printed substrate 50 can be substrate 10, ink 30 placed on substrate 10 to form first unit 40, and metallic ink 20 placed on ink 30. As illustrated in FIG. 9, an optional additional ink 65 can be placed on metallic ink 20 such that printing can be viewed from both sides of substrate 10. The window 60, as shown in FIG. 9, can be a region of the substrate to which no metallic ink 20, ink 30, or additional ink 65 is applied. The opaque printed substrate 50 shown in FIG. 9 can be formed into a package and the printed substrate can be oriented such that substrate 10 is on the interior surface of a package. In the alternative, substrate 10 can be the exterior surface of a package.

Figure 10:
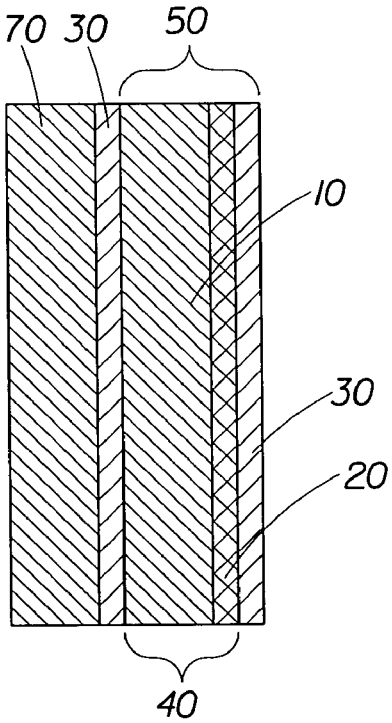
FIG. 10 is a cross sectional view of an opaque printed substrate in which a metallic ink is placed on a substrate, an ink is placed over the metallic ink, an additional ink is placed on the metallic ink, an additional ink is placed on the substrate over which an addition substrate is laminated to the opaque printed substrate.

As shown in FIG. 10, metallic ink 20 can be placed on substrate 10. Together, substrate 10 and metallic ink 20 can form first unit 40. As shown in FIG. 10, metallic ink 20 can be the first application. Ink 30 can be placed on first unit 40 on the side of substrate 10 on which metallic ink 20 is applied. Ink 30 can be placed on both sides of first unit 40. As shown in FIG. 10, ink 30 can be the second application. The opaque printed substrate 50 can be substrate 10, metallic ink 20 placed on substrate 10 forming first unit 40, and ink 30 placed on metallic ink 20. As shown in FIG. 10, an additional substrate 70 can be laminated to substrate 10 on the side of the substrate not having metallic ink. Additional substrate 70 can be oriented such that additional substrate 70 is on the interior surface of a package or on the exterior surface of a package and still provide for printing that can be viewed from both the exterior and interior of a package. Preferably, additional substrate 70 can be a clear substrate or a pigmented substrate through which ink 30 that is between the substrates can be seen. Preferably, additional substrate 70 can be oriented such that additional substrate 70 is on the interior surface of a package to protect ink 30 from adverse interactions with any product contained in a package. A package having the opaque printed substrate 50 oriented in this manner can have ink 30 viewable from outside of the package, ink 30 can be viewable from inside of the package, and ink 30 is protected from exposure to the contents contained within the package. Additional substrate 70 can be the same material as substrate 10 or different material. The additional substrate 70 can have the same thickness as substrate 10 or different thickness. The additional substrate 70 can have opacity that differs from the opacity of substrate 10.

Alternatively, the opaque printed substrate 50 shown in FIG. 10 can be considered to be substrate 10 and the first application can be metallic ink 20 forming first unit 40, and ink 30 placed on metallic ink 20. If ink 30 placed on metallic ink 20 is considered to be the second application, the ink between substrate 10 and additional substrate 70 can be considered to be an additional ink.

Figure 11:
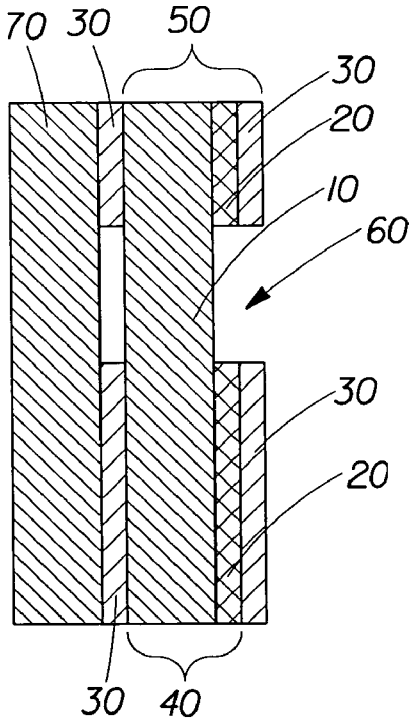
FIG. 11 is a cross sectional view of an opaque printed substrate in which an ink is placed on one side of a substrate, a metallic ink is placed over the ink, an ink is printed on the metallic ink, an additional ink is placed on the other side of the substrate, and an additional substrate is laminated to the opaque printed substrate and the opaque printed substrate has a window.

A cross section of opaque printed substrate 50 illustrated in FIG. 10 having a window is shown in FIG. 11. As shown in FIG. 11, metallic ink 20 can be placed on substrate 10. Together, substrate 10 and metallic ink 20 can form first unit 40. Ink 30 can be placed on first unit 40 on metallic ink 20. Ink 30 can be placed on both sides of first unit 40. The opaque printed substrate 50 can be substrate 10, metallic ink 20 placed on substrate 10 forming first unit 40, and ink 30 placed on metallic ink 20. As shown in FIG. 11, additional substrate 70 can be laminated to substrate 10 on the side of the substrate 10 not having metallic ink. As shown in FIG. 10, the window 60 can be a region of the substrate 10 to which no metallic ink 20, ink 30, or additional ink 65 is applied. Optionally, ink 30 between substrate 10 and additional substrate 70 can cover the window such that the color of objects when viewed through window 60 is color shifted. Optionally, ink 30 can be placed on additional substrate 70 and then additional substrate can be laminated to substrate 10.

An adhesive can be applied to opaque printed substrate 50 shown in FIGS. 9 and 10 to form an adhesive tape and the adhesive tape can have one or more windows 60. An adhesive tape made of a opaque printed substrate could have indicia visible from both sides of the adhesive tape.

Figure 12:
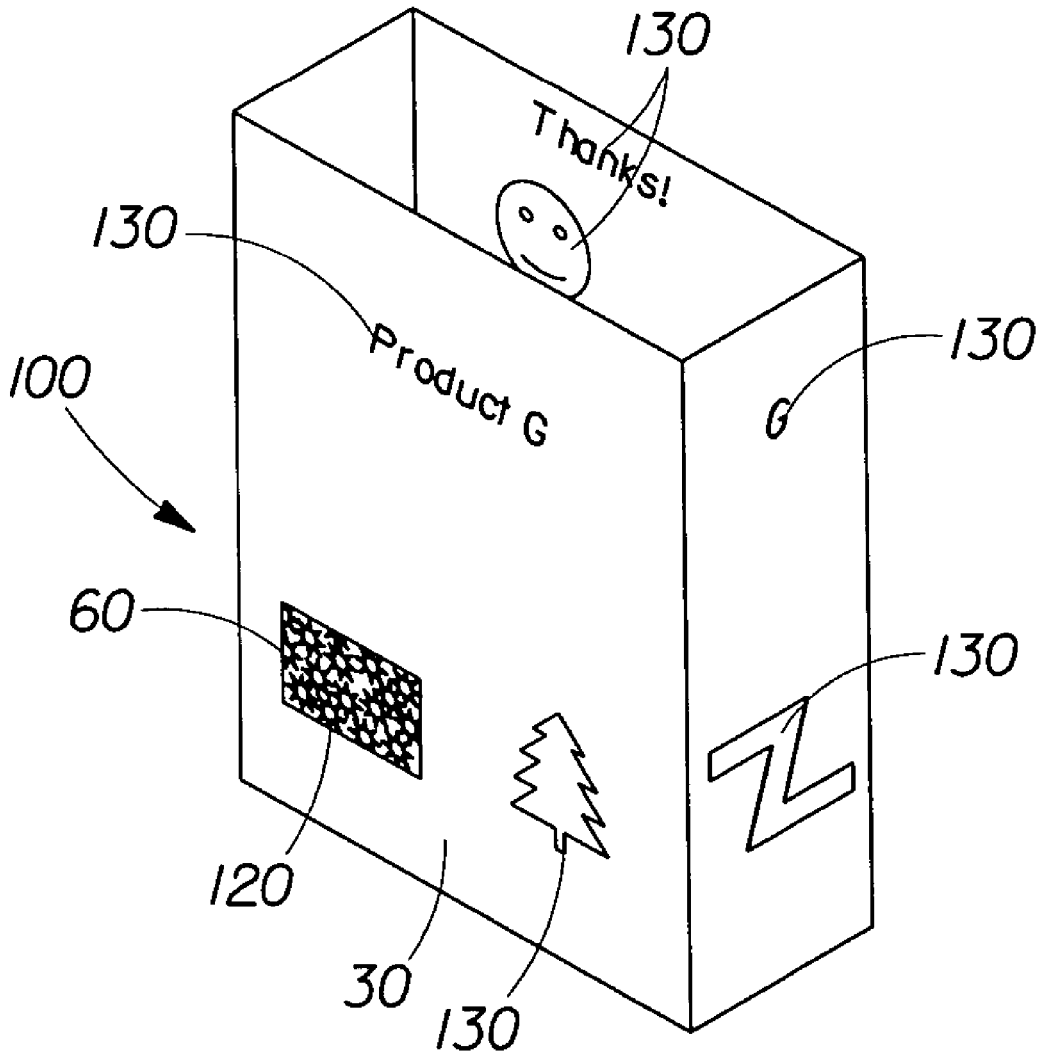
FIG. 12 is an illustration of a package formed of an opaque printed substrate for disposable absorbent articles wherein the package has a window and indicia can be viewed from both sides of the substrate.

FIG. 12 is an illustration of an embodiment of a package integrating the various aspects of the invention. Package 100 can be a package for Product G which has the potential to adversely interact with various types of ink. Package 100 can be formed from an opaque printed substrate 50 and an additional substrate 70 configured as shown in FIG. 10, wherein ink 30 is on the exterior of package 100. Package 100 can have a window 60 through which the contents 120 of package 100 can be seen from the exterior of package 100. Indicia 130 can be viewed from the exterior and interior of package 100. Package 100 can be closed by folding over the open end of the package 100. A re-closable zipper like system or interlocking groove system can be attached to package 100 to permit opening and closing package 100. Package 100 can entirely enclose contents 120 thereby isolating contents 120 from the environment. Different walls of package 100 can be formed out of different substrates, different inks may be applied to different sides of the package, some sides of package 100 may not have any ink applied, and some walls of package 100 can have opacity that differs from the opacity of other walls of package 100.

Metallic ink 20, ink 30, and additional ink 65 can be placed using any methods known in the art including but not limited to gravure printing, flexographic printing, and offset printing, letter press, lithography, plateless, post press, and screen printing. Gravure printing is the direct transfer of liquid ink to substrate from a metal image carrier. The image is lower than the surface of the image carrier base. Flexography printing is the direct transfer of liquid ink to substrate from a photopolymer image carrier. The image is raised above the surface of the image carrier base. Offset printing is the indirect transfer of paste ink to substrate from a rubber 'blanket' that is intermediate to substrate and the thin metal image carrier. Examples of plateless printing include electronic printing, ink jet printing, magnetography, ion deposition printing, direct charge deposition printing, and the Mead Cycolor Photocapsule process.

Metallic ink 20, ink 30, and additional ink 65 can be placed on a printing line in which the first application is printed on substrate 10 and properly fixed to substrate 10. Then the second application is printed on the substrate 10 and properly fixed to substrate 10.

Package 100 can be created by any method known in the art including stitching, melt bonding, chemical bonding, or adhesive to connect free edges of opaque printed substrate 50 to form a package. Package 100 can be made by hand or using automated machine processes known in the art.

Example 1

Example 1 is an opaque printed substrate having a cross section as illustrated in FIG. 1. Substrate 10 is Exopack 1020 film available from Exopack LLC, Spartanburg, S.C. Metallic ink 20 is silver ink TLOFSM038662 available from Sun Chemical Corp., Parsippany, N.J. Ink 30 is white ink TLKFS1035477, also available from Sun Chemical Corp. The opacity of the opaque printed substrate is 95% or greater.

The opaque printed substrate 50 is used to form a package 100 for sanitary napkins. The opaque printed substrate 50 has an irregularly shaped window that is bounded by indicia printed on the package 100. Only a portion of the package could be covered with the metallic ink, thereby permitting the consumer to see the contents of the package. Some portions of the substrate 10 could be printed only with ink 30. Some indicia 130 could be printed with metallic ink 20 and some indicia 130 could be printed with ink 30 to achieve different visual impacts on different parts of the package.

Example 2

Example 2 is an opaque printed substrate 50 as described in Example 1. An adhesive could be applied to the opaque printed substrate 50 to form an adhesive tape. Ink 30 could be decorative artwork or other indicia.

Example 3

Example 3 is an opaque printed substrate 50 as described in Example 1. An adhesive could be applied to the opaque printed substrate 50 to form a shelf cover that could be adhered to a shelf to make the shelf more attractive. In 30 could be decorative artwork or other indicia Example 4

Example 4 is an opaque printed substrate 50 as illustrated in FIG. 1. The substrate 10 could be an absorbent paper material used to manufacture paper towels. Portions of the substrate could be rendered opaque and indicia placed thereupon.

Example 5

Example 5 is an opaque printed substrate 50 as illustrated in FIG. 4. The substrate could be a high density polyethylene having a thickness of 175 microns. The metallic ink and ink could be those listed in Example 1. The opaque printed substrate 50 could be used to form a package 100 for granulated laundry detergent. First unit 40 could be oriented towards the interior of package 100. Ink 30 could be visible from the interior of the package and text "thank you" could be visible from the interior of package 100. Additional ink 65 could be visible from the exterior of package 100 and indicia 130 descriptive of the brand of granulated laundry detergent could be displayed.

Example 6

Example 6 is an opaque printed substrate 50 as illustrated in FIG. 1. The opaque printed substrate 50 could be used to form a package 100 for liquid laundry detergent. Substrate could be high density polyethylene having a thickness of 1000 microns that is pigmented bright orange. A portion of package 100 could be opaque printed substrate 50 wherein ink 30 is indicia 130 descriptive of the brand of liquid laundry detergent.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for making a packaged consumer product, the method comprising the steps of:

(a) providing an opaque printed substrate comprising:

i) a clear substrate;

ii) a first application of ink on a first region of the clear substrate, the first application of ink selected from the group consisting of metallic ink and ink;

iii) a second application of ink on a second region of the clear substrate, the second application of ink selected from the group consisting of metallic ink and ink, wherein the second region does not completely overlap the first region so as to define a window in the non-overlapping section that contains the first application of ink;

(b) providing a plurality of individually wrapped disposable absorbent articles, each of which comprising over-wrapping material; and (c) forming a package for containing the plurality of individually wrapped disposable absorbent articles from the opaque printed substrate;

(d) wherein the over-wrapping material, when viewed through the window containing the first application of ink, appears to have a different color than if viewed directly with no opaque printed substrate between a viewer and the over-wrapping material.

2. The method of claim 1, wherein the disposable absorbent articles are sanitary napkins.

3. A method for making a packaged consumer product, the method comprising the steps of:

(a) providing an opaque printed substrate comprising:

i) a clear substrate;

ii) a first application of ink on the clear substrate, the first application of ink selected from the group consisting of metallic ink and ink;

iii) a second application of ink on the clear substrate, the second application of ink selected from the group consisting of metallic ink and ink;

iv) a window defined in the clear substrate that only contains one of the first application of ink or the second application of ink;

(b) providing a plurality of individually wrapped disposable absorbent articles, each of which comprising over-wrapping material; and (c) forming a package for containing the plurality of individually wrapped disposable absorbent articles from the opaque printed substrate;

(d) wherein the over-wrapping material, when viewed through the window containing one of the first application of ink or the second application of ink, appears to have a different color than if viewed directly with no opaque printed substrate between a viewer and the over-wrapping material.

4. The method of claim 3, wherein the disposable absorbent articles are sanitary napkins.

* * * * *